US006767089B2

(12) United States Patent
Buswell et al.

(10) Patent No.: US 6,767,089 B2
(45) Date of Patent: Jul. 27, 2004

(54) SLOTTED SEMICONDUCTOR SUBSTRATE HAVING MICROELECTRONICS INTEGRATED THEREON

(75) Inventors: Shen Buswell, Monmouth, OR (US); Paul A. Templin, Encinitas, CA (US); Conrad Jenssen, Corvallis, OR (US); Mark H. MacKenzie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

(21) Appl. No.: 10/080,747

(22) Filed: Feb. 22, 2002

(65) Prior Publication Data

US 2002/0180860 A1 Dec. 5, 2002

Related U.S. Application Data

(62) Division of application No. 09/872,775, filed on Jun. 1, 2001, now abandoned.

(51) Int. Cl.[7] ..... B41J 2/175; B41J 2/015

(52) U.S. Cl. ..... 347/86; 347/20

(58) Field of Search ..... 347/20, 47, 48, 347/54, 56, 61, 62

(56) References Cited

U.S. PATENT DOCUMENTS

| | | | | |
|---|---|---|---|---|
| 2,587,994 A | | 3/1952 | Gregory | |
| 4,046,985 A | | 9/1977 | Gates | |
| 4,463,359 A | | 7/1984 | Ayata et al. | |
| 4,680,859 A | | 7/1987 | Johnson | |
| 4,683,481 A | | 7/1987 | Johnson | |
| 4,746,935 A | | 5/1988 | Allen | |
| 4,878,992 A | | 11/1989 | Campanelli | |
| 4,931,811 A | | 6/1990 | Cowger et al. | |
| 4,965,610 A | | 10/1990 | Ishikawa | |
| 5,193,595 A | | 3/1993 | Johnson et al. | |
| 5,218,376 A | | 6/1993 | Asai | |
| 5,278,584 A | | 1/1994 | Keefe et al. | |
| 5,305,015 A | | 4/1994 | Schantz et al. | |
| 5,306,370 A | | 4/1994 | Herko et al. | |
| 5,363,133 A | * | 11/1994 | Sugahara et al. | 347/69 |
| 5,402,159 A | * | 3/1995 | Takahashi et al. | 347/9 |
| 5,659,345 A | | 8/1997 | Altendorf | |
| 5,754,202 A | | 5/1998 | Sekiya et al. | |
| 5,793,393 A | | 8/1998 | Coven | |
| 5,971,528 A | * | 10/1999 | Yoshimura | 347/69 |
| 6,132,034 A | * | 10/2000 | Miller | 347/65 |
| 6,182,546 B1 | | 2/2001 | Hecker | |
| 6,291,317 B1 | | 9/2001 | Salatino et al. | |

* cited by examiner

*Primary Examiner*—Stephen D. Meier
*Assistant Examiner*—An H. Do

(57) ABSTRACT

The exemplary embodiments describe a semiconductor substrate having microelectronics integrated thereon. In one exemplary embodiment, the semiconductor substrate comprises a plurality of fluid ejecting elements positioned over a substrate. The semiconductor substrate can further comprise one or more fluid feed channel(s) formed in the substrate. The one or more fluid feed channel(s) being configured to deliver fluid to the plurality of fluid ejecting elements. The one or more fluid feed channel(s) are defined at least in part by first and second substantially parallel side walls and first and second non-parallel end walls.

32 Claims, 8 Drawing Sheets

SLOTTED SEMICONDUCTOR SUBSTRATE HAVING MICROELECTRONICS INTEGRATED THEREON

RELATED APPLICATIONS

This application is a divisional application of U.S. patent application Ser. No. 09/872,775 entitled "Inkjet Printhead Having A Saw Cut Ink Feed Slots and Method of Fabricating Such an Inkjet Printhead" filed on Jun. 1, 2001 now abandoned, the disclosure of which is incorporated by reference herein.

BACKGROUND OF THE INVENTION

Throughout the business world, inkjet printing systems are extensively used for image reproduction. Inkjet printing systems frequently make use of an inkjet printhead mounted within a carriage that is moved back and forth across print media, such as paper. As the printhead is moved across the print media, a control system activates the printhead to deposit or eject ink droplets onto the print media to form images and text. Such systems may be used in a wide variety of applications, including computer printers, plotters, copiers, facsimile machines, and other printing devices.

Ink is provided to the printhead by a supply of ink that is either carried by the carriage or mounted to the printing system such that the supply of ink does not move with the carriage. For the case where the ink supply is not carried with the carriage, the ink supply can be in fluid communication with the printhead to the ink supply is connected whereupon the printhead is replenished with ink from the refilling station.

For the case where the ink supply is carried with the carriage, the ink supply may be integral with the printhead whereupon the entire printhead and ink supply is replaced when ink is exhausted. Alternatively, the ink supply can be carried with the carriage and be separately replaceable from the printhead.

For convenience, the concepts of the invention are discussed in the context of thermal inkjet printheads. A thermal inkjet printhead die includes an array of firing chambers having orifices (also called nozzles) which face the print media. The ink is applied to individually addressable ink energizing or ejecting elements (such as firing resistors) within the firing chambers. Energy provided by the firing resistors heats the ink within the firing chambers causing the ink to bubble. This in turn causes the ink to be expelled out of the orifice of the firing chamber toward the print media. As the ink is expelled, the bubble collapses and more ink is drawn into the firing chambers, allowing for repetition of the ink expulsion process.

Inkjet printhead dies are in part manufactured using processes that employ photolithographic techniques similar to those used in semiconductor manufacturing. The components are constructed on a flat substrate layer of silicon by selectively adding layers of various materials and subtracting portions of the substrate layer and added layers using these photolithographic techniques. Some existing inkjet printhead dies are defined by a silicon substrate layer having firing resistors within a stack of thin film layers, a barrier layer and an orifice layer or orifice plate. Material removed from the barrier layer defines the firing chambers, while openings within the orifice layer or plate define the nozzles for the firing chambers.

In an inkjet printhead die, ink is delivered to the firing chambers and thereby the firing resistors by either a slotted ink delivery system or an edgefeed ink delivery system. In a slotted ink delivery system, the inkjet printhead die includes one or more slots that route ink from a backside of the printhead die to a front side where the firing resistors reside on at least one side of each of the slots. To form the ink feed slots of the printhead die, material is typically removed from the silicon substrate layer by directing a high pressure mixture of sand and air at the silicon substrate layer.

Generally, a single color printhead die includes a single ink delivery slot with one column of firing resistors on each side of the slot. However, a single color printhead die may include multiple slots to improve print quality and/or speed. A multicolor printhead die typically includes an ink delivery slot for each color. Generally, the printhead die is mounted to a printhead cartridge body using a structural adhesive. In multicolor print cartridges having a printhead die with multiple slots, this structural adhesive is deposited in a loop around each individual slot to separate out the individual ink colors.

Although this slotted ink delivery system for inkjet printhead dies adequately delivers ink to the firing resistors, there are some disadvantages to this system of ink routing. The primary disadvantages are die strength, size and manufacturing inefficiencies. With regard to strength, in a printhead die, the ink delivery slot(s) structurally weaken the printhead die. As such, the greater the size of the slots and/or the greater the number of slots the weaker the die. With regard to size, the ink delivery slots can only be put so close together before manufacturability issues arise that causes manufacture of the printhead die to be accomplished in less than an optimal cost efficient manner. As such, the width of the ink delivery slots and the spacing of the ink delivery slots limits how small the printhead die can be. Lastly with regard to manufacturing inefficiencies, use of the high pressure mixture of sand and air to form the ink feed slots in the printhead die limits the overall size of the individual slots. For example, to produce an ink delivery slot having a width of less than 300 $\mu$m and a length greater than 5000 $\mu$m can require huge increases in manufacturing cycle times along with reductions in manufacturing yields. As such, due to the inherent limitations of the high pressure sand and air ink feed slot formation process, this process is only economically feasible to produce ink feed slots having widths of greater than 300 $\mu$m and lengths less than 5000 $\mu$m.

Typically to obtain print quality and speed, it is necessary to maximize the density of the firing chambers (i.e. firing resistors) and/or increase the number of firing chambers. Maximizing the density of the firing chambers and/or increasing the number of firing chambers typically necessitates an increase in the size of the printhead die and/or a miniaturization of printhead die components. As discussed above, when the density is sufficiently high, conventional manufacturing by assembling separately produced components becomes more difficult and costly. In addition, the substrate that supports firing resistors, the barrier that isolates individual resistors, and the orifice plate that provides a nozzle above each resistor are all subject to small dimensional variations that can accumulate to limit miniaturization. Further, the assembly of such components for conventional printheads requires precision that limits manufacturing efficiency.

As such, there is a desire to form improved slotted substrates that can be incorporated into various fluid ejecting devices and printing devices. An example of which can be a printhead die employing a slotted ink delivery system that is economical to manufacture, and relatively simple to incorporate into inkjet printhead cartridges useable in thermal inkjet printing systems. In particular, the printhead die and the process for manufacturing the printhead die should allow the formation of ink feed slots having widths less than 300 μm and/or lengths greater than 5000 μm while maintaining manufacturing efficiencies. Moreover, the printhead die and the process for manufacturing the printhead die should allow an overall reduction in the size of the printhead die while maintaining the same number of firing resistors or allow more firing resistors to be included in the same printhead die size.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

A replaceable inkjet printhead cartridge 16 useable in a thermal inkjet printing system 10 in accordance with the present invention is illustrated generally in FIGS. 1–4. The printhead cartridge 16 includes a printhead die 40 that delivers fluid to firing resistors 70 positioned within the printhead die 40 using a slotted ink delivery system.

Figure 1:
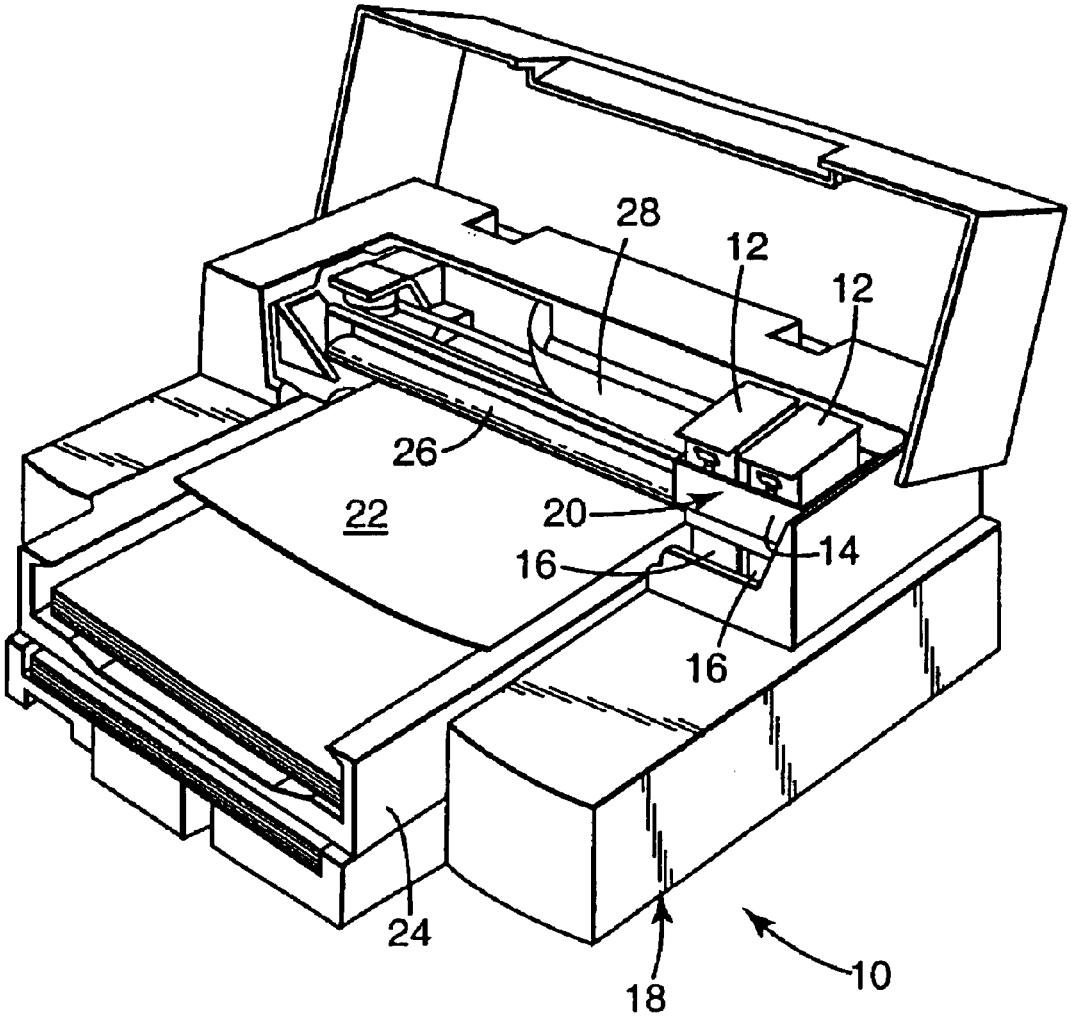
FIG. 1 is a perspective view of a thermal inkjet printing system with a cover opened to show a plurality of replaceable ink containers and a plurality of replaceable inkjet printhead cartridges incorporating inkjet printhead dies having printhead substrates in accordance with the present invention.

In FIG. 1, the printing system 10, shown with its cover open, includes at least one replaceable fluid container 12 that is installed in a receiving station 14. In one preferred embodiment, the printing system 10 includes two replaceable fluid containers 12, with one single color fluid container 12 containing a black ink supply, and one multi-color fluid container 12 containing cyan, magenta and yellow ink supplies. With the replaceable fluid containers 12 properly installed into the receiving station 14, fluid, such as ink, is provided from the replaceable fluid containers 12 to at least one inkjet printhead cartridge 16. In one preferred embodiment, the printing system 10 includes two replaceable printhead cartridges 16, with one single color printhead cartridge 16 for printing from the black ink supply, and one multi-color printhead cartridge 16 for printing from the cyan, magenta and yellow ink supplies.

In operation, the inkjet printhead cartridges 16 are responsive to activation signals from a printer portion 18 to deposit fluid on print media 22. As fluid is ejected from the printhead cartridges 16, the printhead cartridges 16 are replenished with fluid from the fluid containers 12. In one preferred embodiment, the replaceable fluid containers 12, receiving station 14, and the replaceable inkjet printhead cartridges 16 are each part of a scanning carriage 20 that is moved relative to the print media 22 to accomplish printing. The printer portion 18 includes a media tray 24 for receiving the print media 22. As the print media 22 is stepped through a print zone, the scanning carriage 20 moves the printhead cartridges 16 relative to the print media 22. Each printhead cartridge 16 has an inkjet printhead die 40. The printer portion 18 selectively activates the printhead dies 40 (see FIGS. 3A, 3B and 4) of the printhead cartridges 16 to deposit fluid on print media 22 to thereby accomplish printing.

The scanning carriage 20 of FIG. 1 slides along a slide rod 26 to print along a width of the print media 22. A positioning means (not shown) is used for precisely positioning the scanning carriage 20. In addition, a paper advance mechanism (not shown) moves the print media 22 through a print zone as the scanning carriage 20 is moved along the slide rod 26. Electrical signals are provided to the scanning carriage 20 for selectively activating the printhead dies 40 of the printhead cartridges 16 by means of an electrical link, such as a ribbon cable 28.

Figure 2:
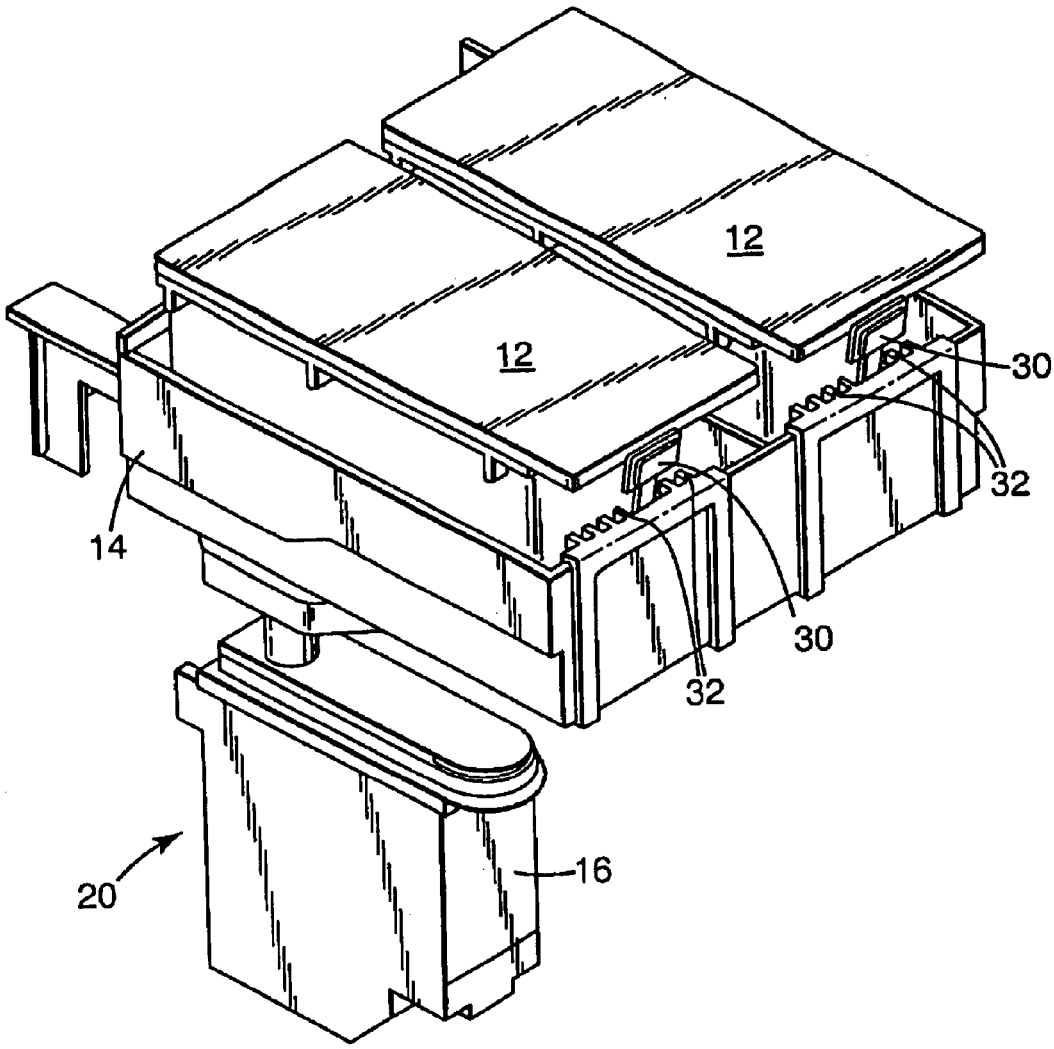
FIG. 2 is a perspective view a portion of a scanning carriage showing the replaceable ink containers positioned in a receiving station that provides fluid communication between the replaceable ink containers and one or more printhead cartridges incorporating inkjet printhead dies having printhead substrates in accordance with the present invention.

FIG. 2 is a perspective view of a portion of the scanning carriage 20 showing the pair of replaceable fluid containers 12 properly installed in the receiving station 14. For clarity, only a single inkjet printhead cartridge 16 is shown in fluid communication with the receiving station 14. As seen in FIG. 2, each of the replaceable fluid containers 12 includes a latch 30 for securing the replaceable fluid container 12 to the receiving station 14. In addition, the receiving station 14 includes a set of keys 32 that interact with corresponding keying features (not shown) on the replaceable fluid containers 12. The keying features on the replaceable fluid containers 12 interact with the keys 32 on the receiving station 14 to ensure that the replaceable fluid containers 12 are compatible with the receiving station 14.

Figure 3A:
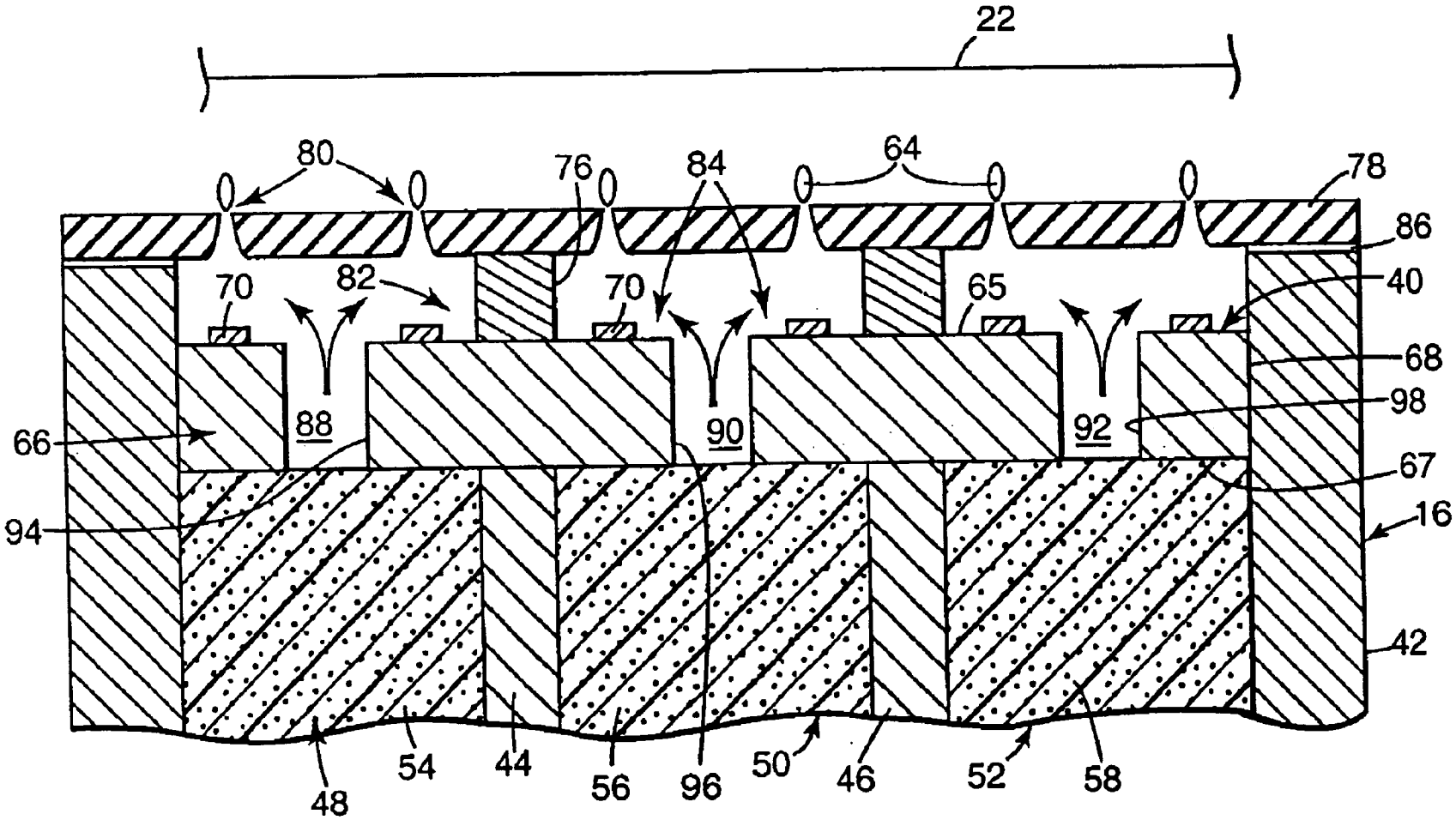
FIG. 3A is a partial sectional view of the inkjet printhead die having a printhead substrate in accordance with the present invention shown mounted to a multicolor inkjet printhead cartridge of FIG. 1.

As seen in FIG. 3A, the tri-color printhead cartridge 16 includes a cartridge body 42 having partition walls 44 and 46 that separate the cartridge body 42 into three separate chambers 48, 50 and 52. The first chamber 48 includes a first capillary member 54 for a first ink color (i.e., cyan), the second chamber 50 includes a second capillary member 56 for a second ink color (i.e., magenta), and the third chamber 52 includes a third capillary member 58 for a third ink color (i.e., yellow). The first, second and third capillary members 54, 56, 58 receive their respective color ink from the tri-color fluid container 12.

Figure 3B:
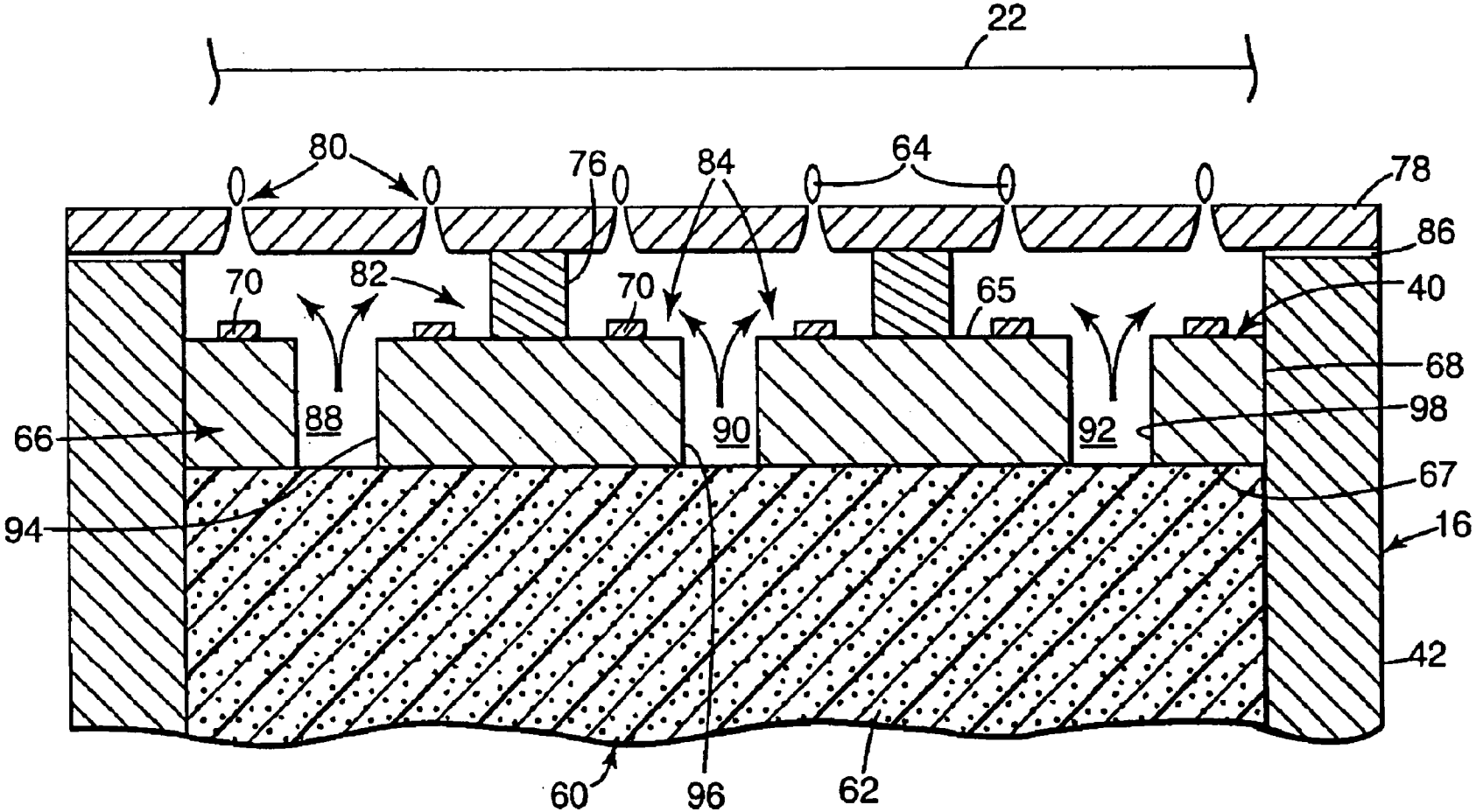
FIG. 3B is a partial sectional view similar to FIG. 3A of the inkjet printhead die having a printhead substrate in accordance with the present invention shown mounted to a single color inkjet printhead cartridge of FIG. 1.

In FIG. 3B, the cartridge body 42 of the single color inkjet printhead cartridge 16 includes a single chamber 60 having a single capillary member 62 for a single color. In one preferred embodiment, this single color is black. The single capillary member 62 receives its respective color ink from the single color fluid container 12.

As seen in FIGS. 3A and 3B each of the tri-color (FIG. 3A) and single color (FIG. 5A) inkjet printhead cartridges 16 includes one inkjet printhead die 40 in accordance with the present invention. Because the printhead dies 40 of the single color and tri-color printhead cartridges 16 are similar only the printhead die 40 in connection with the tri-color printhead cartridge 16 of FIG. 3A will be described with particularity.

As seen in FIG. 3A, the inkjet printhead die 40 of the present invention functions to eject ink droplets 64 onto a print medium 22. The printhead die 40 is defined by a substrate 66 that includes a base layer, such as a semiconductor silicon substrate 68 in accordance with the present invention. The silicon substrate 68 has a first major surface 65 and an opposite second major surface 67. The silicon substrate 68 (i.e., base layer) provides a rigid chassis for the printhead die 40, and accounts for the majority of the thickness of the printhead die 40. On top of the silicon substrate 68 are a plurality of independently addressable ink energizing elements, such as firing resistors 70 (shown in FIG. 4) for heating ink to generate the ink droplets 64 in a known manner. In one preferred embodiment, the firing resistors 70 form part of a stack of thin film layers on top of the silicon substrate 68. On top of the silicon substrate 68 is a barrier layer 76, such as a photoresist polymer substrate. On top of the barrier layer 76 is an orifice plate 78, such as a Ni substrate.

Figure 4:
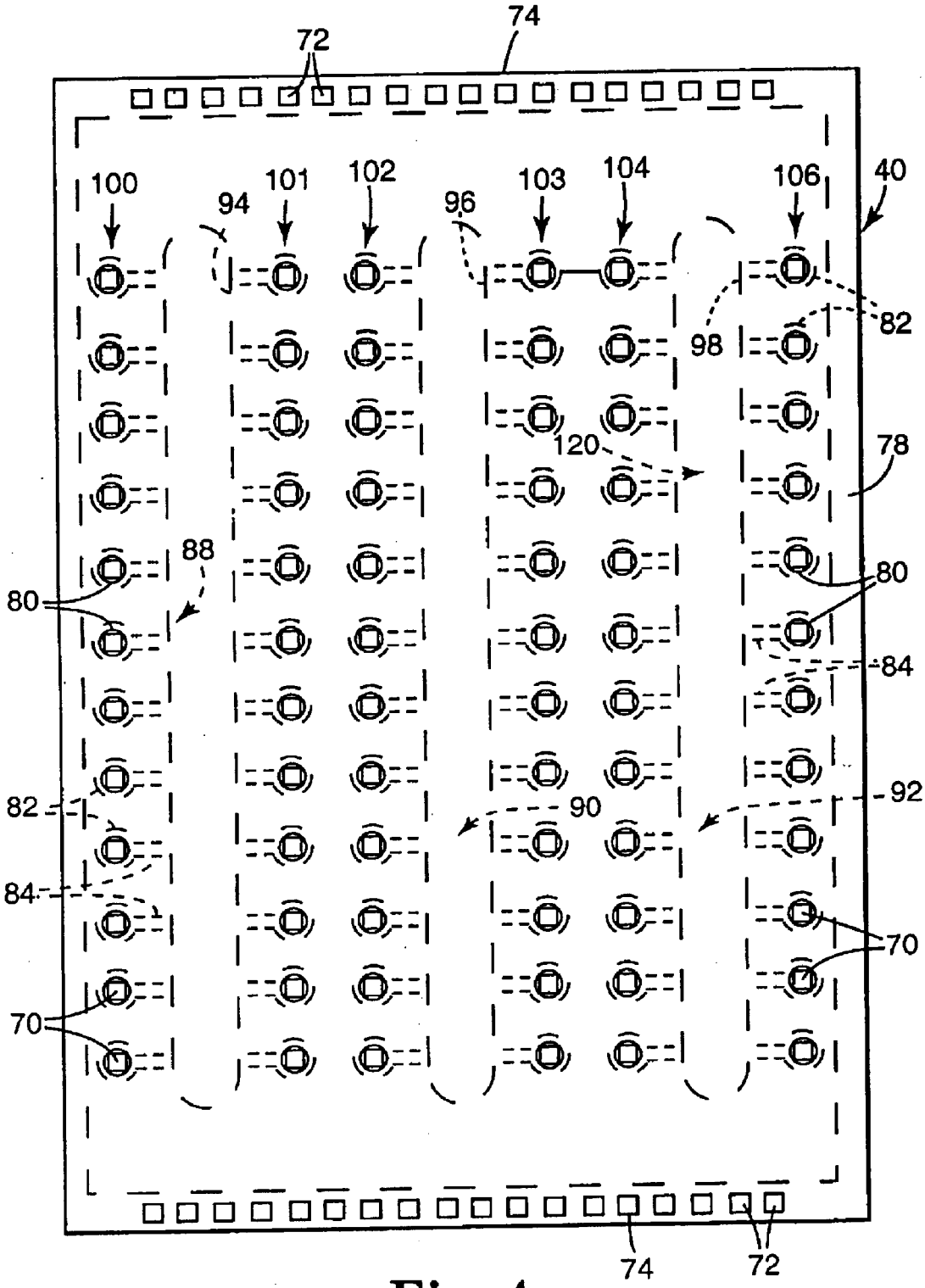
FIG. 4 is an enlarged plan view of the inkjet printhead die shown in FIG. 3.

As seen in FIG. 4, the die 40 has short side edges 74. The firing resistors 70 are electrically linked (not shown) to electrical interconnects 72 on the short side edges 74. In a known manner, the electrical interconnects 72 contact printer portion 18 contacts (not shown) to provide the energizing signals to the firing resistors 70.

As seen in FIGS. 3A and 4, the orifice plate 78 includes a plurality of nozzles 80 through which the ink droplets 64 are ejected. One nozzle 80 is associated with each firing resistor 70. The barrier layer 76 defines a plurality of firing chambers 82 for the firing resistors 70. One nozzle 80 and one firing resistor 70 is associated with each firing chamber 82. The barrier layer 76 also defines a plurality of ink feed passageways 84 (See FIG. 4) for delivering ink to the firing chambers 82. In one preferred embodiment, one ink feed passageway 84 is associated with each firing chamber 82. Alternatively, multiple ink feed passageways 84 could be associated with each firing chamber 82. As seen in FIG. 3A, in one embodiment, the orifice plate 78 may be oversized (i.e., larger than the barrier layer 76 and the silicon substrate 68) to allow the inkjet printhead die 40 to be mounted to the cartridge body 42 using a suitable adhesive 86.

As seen in FIG. 3A, the silicon substrate 68 defines first, second and third ink refill channels 88, 90 and 92, respectively, in accordance with the present invention, for delivering ink to the plurality of ink feed passageways 84 and ultimately to the firing chambers 82 for the firing resistors 70. The first ink refill channel 88 is defined by a first ink feed slot 94 extending through the silicon substrate 68 from the first major surface 65 to the second major surface 67. The second ink refill channel 90 is defined by a second ink feed slot 96 extending through the silicon substrate 68 from the first major surface 65 to the second major surface 67. The third ink refill channel 92 is defined by a third ink feed slot 98 extending through the silicon substrate 68 from the first major surface 65 to the second major surface 67. As seen in FIG. 4, the first, second and third ink feed slots 94, 96, 98 extend parallel to one another.

As seen in FIG. 4, the first ink feed slot 94 is operatively associated with a first multiplicity or at least one column of firing resistors 70. In one preferred embodiment, the first ink feed slot 94 is operatively associated with a first multiplicity of firing resistors 70 defined by two columns 100 and 101 of firing resistors 70 immediately adjacent to each side of the slot 94. The second ink feed slot 96 is operatively associated with a second multiplicity or at least one column of firing resistors 70. In one preferred embodiment, the second ink feed slot 96 is operatively associated with a second multiplicity of firing resistors 70 defined by two columns 102 and 103 of firing resistors 70 immediately adjacent to each side of the slot 96. The third ink feed slot 98 is operatively associated with a third multiplicity or at least one column of firing resistors 70. In one preferred embodiment, the third ink feed slot 98 is operatively associated with a third multiplicity of firing resistors 70 defined by two columns 104 and 106 of firing resistors 70 immediately adjacent to each side of the slot 98.

For the tricolor printhead cartridge, the first, second and third ink feed slots 94, 96, 98 fluidically communicate with the first, second and third capillary members 54, 56, 58, respectively, such that the first set of columns 100, 101 of firing resistors 70 eject a first ink color (i.e., cyan), the second set of columns 102, 103 of firing resistors 70 eject a second ink color (i.e., magenta), and the third set of columns 104, 106 of firing resistors 70 eject a third ink color (i.e., yellow). In the single color inkjet printhead cartridge 16 of FIG. 3B there is only a single capillary member 62 with which all the ink feed slots 94, 96, 98 fluidically communicate. As such, the first, second, third sets of columns 100, 101, 102, 103, 104, 106 of firing resistors 70 all eject a single ink color (i.e., black).

Figure 5:
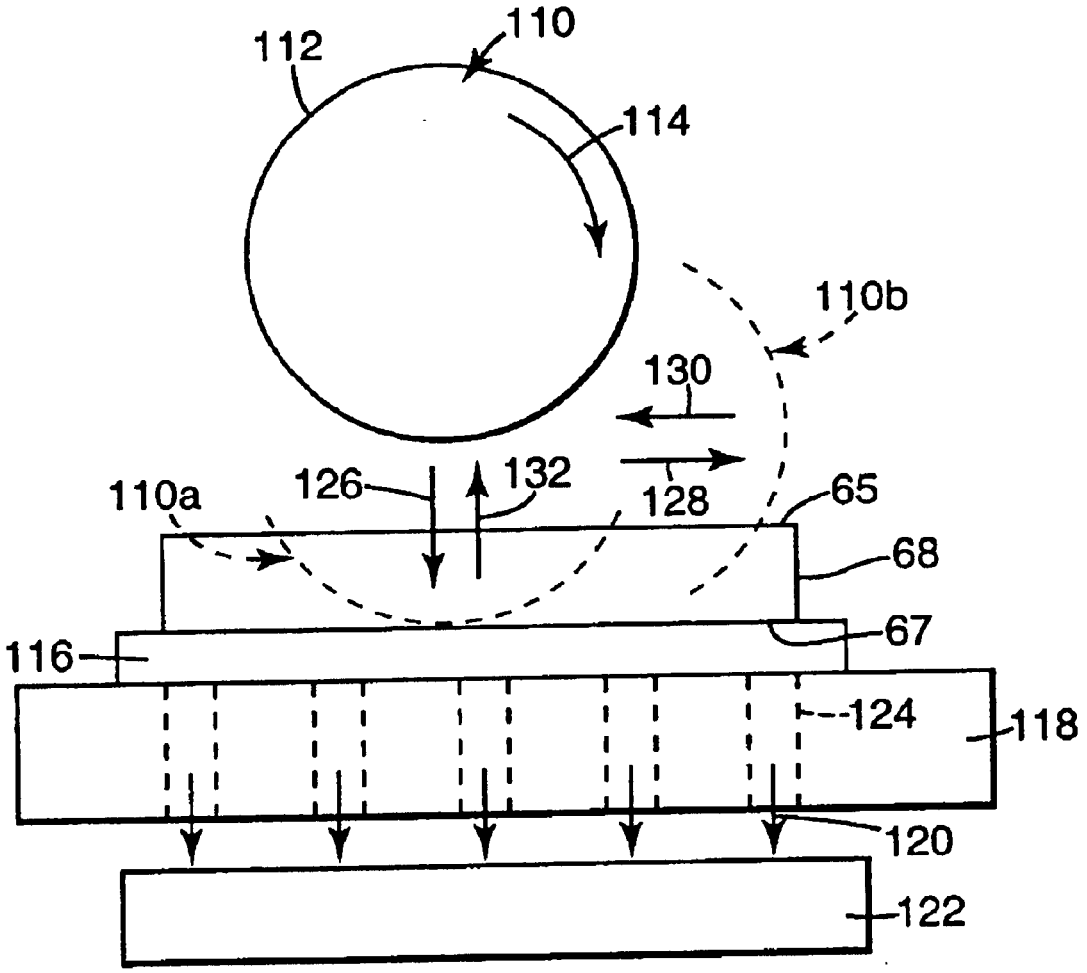
FIG. 5 is a side elevational view illustrating a preferred method of fabricating an ink feed slot in the printhead substrate of the inkjet printhead die in accordance with the present invention.

FIG. 5 is a side elevational view illustrating a preferred method of fabricating the ink feed slots 94, 96, and 98 in the printhead silicon substrate 68 of the inkjet printhead die 40 in accordance with the present invention. All the ink feed slots 94, 96, 98 are formed in the same manner so only to formation of the ink feed slot 94 will be described with particularity. As seen in FIG. 5, the ink feed slot 94 is cut in the silicon substrate 68 using a cutting saw, such as a rotating (i.e., rotary) cutting saw 110. The rotary cutting saw 110 has a diamond encrusted peripheral cutting edge 112 that performs the cutting operation upon rotation of the rotary cutting saw 110 in a clockwise direction 114.

In practice, to perform the preferred method of fabrication in accordance with the present invention, an adhesive tape 116 is first applied to the second major surface 67 of the silicon substrate 68. The adhesive tape 116 allows for easier handling of the silicon substrate 68, provides a cushion during the actual cutting process, reduces vibration during the cutting process, and reduces unwanted chipping during the cutting process.

Once the adhesive tape 116 is applied to the silicon substrate 68, the silicon substrate 68 with the attached tape 116 is placed into position atop a fixture 118 beneath the rotary cutting saw 110 such that the first major surface 67 of the silicon substrate 68 faces the saw 110. The silicon substrate 68 is held in a fixed position relative to the rotary cutting saw 110 atop the fixture 118 via vacuum pressure 120 provided by a vacuum source 122. In one embodiment, the fixture 118 includes apertures 124 that allow the vacuum pressure 120 to act on the tape 116 on the second major surface 67 of the silicon substrate 68 to hold the substrate 68 in the desired position.

With the silicon substrate 68 held in a fixed position, the rotary cutting saw 110 is turned on to rotate the saw 110 in clockwise direction 114. Next the rotary cutting saw 110 is lowered in a vertical direction to engage and plunge cut (see dashed line representation 110*a* of the saw 110) the silicon substrate 68. In particular, the rotary cutting saw 110 is moved in a first direction 126 perpendicular to the first major surface 65 of the silicon substrate 68 to partially form the ink feed slot 94. The saw 110 is only lowered to the adhesive tape 116. Next, the rotary cutting saw 110 is moved horizontally to drag cut (see dashed line representation 110*b* of the saw 110) the silicon substrate 68. In particular, the rotary cutting saw 110 is moved in a second direction 128 parallel to the first major surface 65 of the silicon substrate 68 to complete formation of the ink feed slot 94. Once the slot 94 is formed, the rotary cutting saw 110 is moved back to its starting position (shown in solid lines in FIG. 5) along horizontal direction 130 and vertical direction 132, the vacuum source 122 is turned off and the silicon substrate 68 is removed from the fixture 118 to complete the ink feed slot formation process. The silicon substrate 68 is then combined with other elements of the printhead die 40 in a known manner to complete the printhead assembly process.

Figure 7:
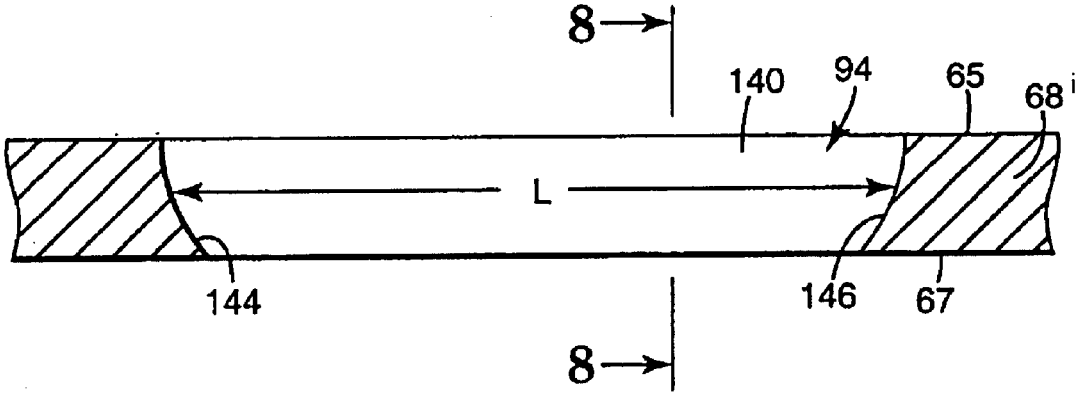
FIG. 7 is an enlarged partial side sectional view illustrating the ink feed slot in the printhead substrate formed using the methods of fabrication illustrated in FIG. 5 or 6.
Figure 8:
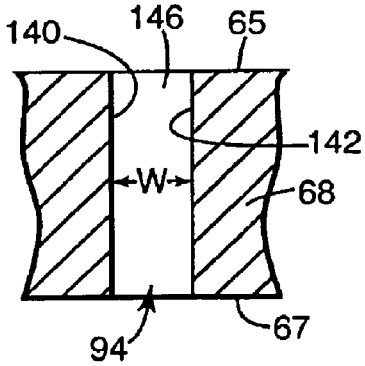
FIG. 8 is an enlarged partial end sectional view taken along line 8—8 in FIG. 7 illustrating the ink feed slot in the printhead substrate formed using the methods of fabrication illustrated in FIG. 5 or 6.

As seen in FIGS. 7 and 8, the above method of fabrication produces an ink feed slot 94 defined by first and second parallel side walls 140 and 142, respectfully, and first and second, non-linear, non-parallel end walls 144 and 146, respectfully. In particular, the first and second end walls 144, 146 are not perpendicular to the first and second major surfaces 65, 67 of the silicon substrate 68. Specifically the first and second end walls 144, 146 are curved such that the first end wall 144 is defined by a first arc having a first radius of curvature, and the second end wall 146 is defined by a second arc having a second radius of curvature that is substantially equal to the first radius of curvature. These curved end walls 144, 146 have been shown to produce a stronger silicon substrate 68 then that produced using conventional slot formation techniques that produce end walls that are linear, parallel and perpendicular to the major surfaces of the silicon substrate. In one preferred embodiment, a two inch diameter rotary cutting saw 110 is used to form the slot 94 which produces end walls 144, 146 having a one inch radius of curvature.

As seen in FIGS. 7 and 8, in accordance with the present invention, the rotary cutting saw 110 produces an ink feed slot 94 having a width dimension W defined as the distance between the first and second side walls 140, 142 and a length dimension L defined as the distance between median of the first and second end walls 144, 146. As is readily understood, the rotary cutting saw 110 produces a slot 94 as wide as the thickness of the saw 110. As such, an ink feed slot 94 having a width dimension W as small as 15 $\mu$m can be formed in the silicon substrate 68. In particular, the rotary cutting saw 110 can be used to produce an ink feed slot 94 having a width dimension W of at least 15 $\mu$m and less than 300 $\mu$m. In one preferred embodiment the width dimension W is 200 $\mu$m. In addition, as is readily apparent, the rotary cutting saw 110 can be used to produce an ink feed slot 94 of almost any length dimension L of at least 5000 $\mu$m. Typically, the rotary cutting saw 110 is used to form an ink feed slot 94 having a length dimension L of at least 8000 $\mu$m. In one preferred embodiment the length dimension L is 8750 $\mu$m.

Figure 6:
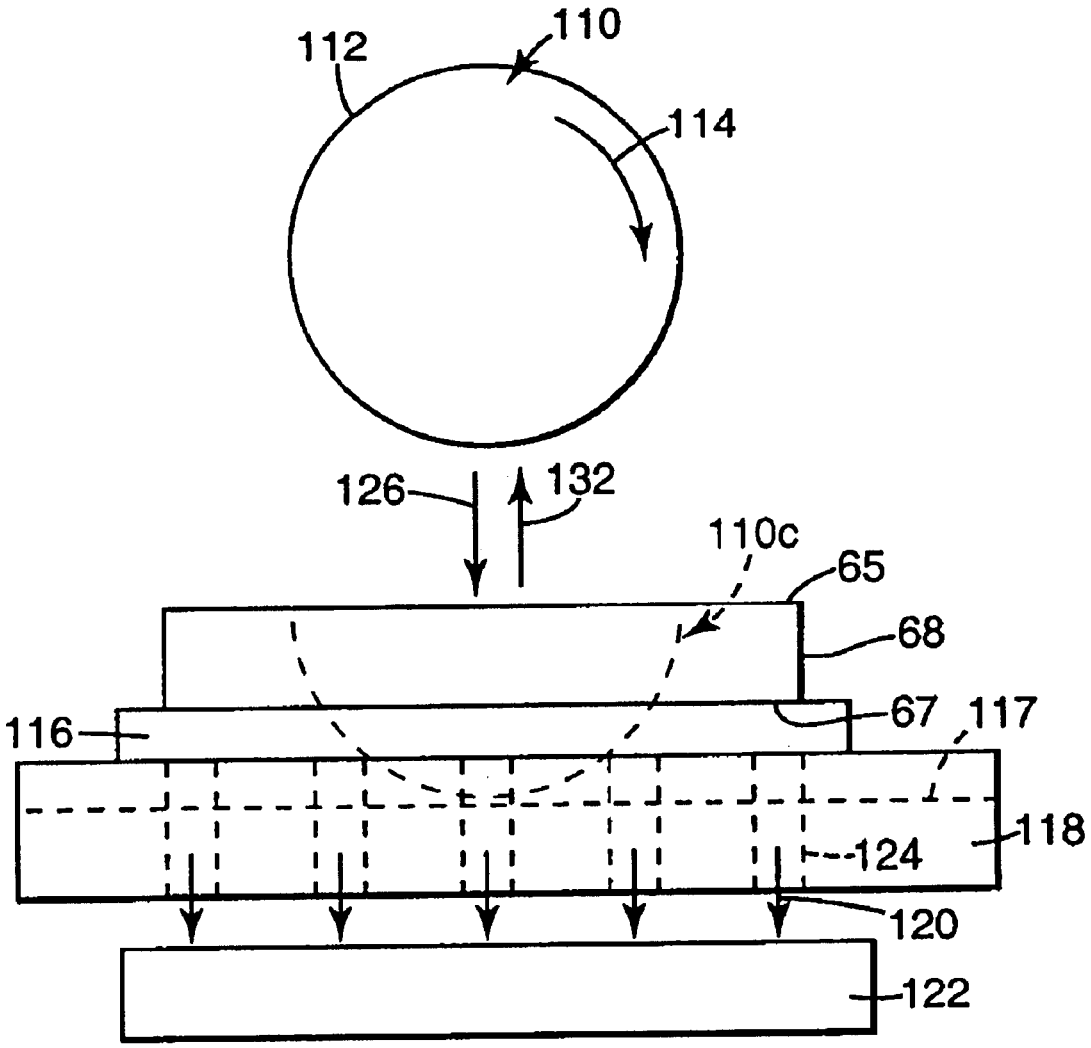
FIG. 6 is a side elevational view similar to FIG. 5 illustrating an alternative method of fabricating an ink feed slot in the printhead substrate of the inkjet printhead die in accordance with the present invention.

FIG. 6 is a side elevational view similar to FIG. 5 illustrating an alternative method of fabricating the ink feed slot 94 (as well as the ink feed slots 96, 98) in the printhead silicon substrate 68 of the inkjet printhead die 40 in accordance with the present invention. As with the preferred fabrication embodiment, the tape 116 is applied to the silicon substrate 68 and the silicon substrate is held in a fixed position on the fixture 118 via vacuum pressure 120 provided by the vacuum source 122.

With the silicon substrate 68 held in a fixed position, the rotary cutting saw 110 is turned on to rotate the saw 110 in clockwise direction 114. Next the rotary cutting saw 110 is only lowered in a vertical direction to engage and plunge cut (see dashed line representation 110*c* of the saw 110) the silicon substrate 68. The saw 110 is lowered so as to pass completely through the tape 116 and into a slot 117 formed in the fixture 118 to accommodate the saw 110. In particular, the rotary cutting saw 110 is moved only in the first direction 126 perpendicular to the first major surface 65 of the silicon substrate 68 to completely form the ink feed slot 94. Once the slot 94 is formed, the rotary cutting saw 110 is moved back to its starting position (shown in solid lines in FIG. 6) along the vertical direction 132, the vacuum source 122 is turned off and the silicon substrate 68 is removed from the fixture 118 to complete the ink feed slot formation process. The silicon substrate 68 is then combined with other elements of the printhead die 40 in a known manner to complete the printhead assembly process.

This printhead die 40 having a silicon substrate 68 produced in accordance with the present invention, substantially minimizes the size, strength and manufacturing efficiency issues associated with present slotted printhead dies. In particular, the use of a rotary cutting saw 110 to form the ink delivery slots 94, 96, 98 in the substrate 68 of the printhead die 40 produces narrower ink delivery slots while maintaining manufacturing efficiencies. Specifically, the rotary cutting saw 110 can be used to form an ink delivery slot 94, 96, 98 having a width of as small as 15 $\mu$m. Smaller ink delivery slot widths allows the printhead substrate 68 of the present invention to exhibit an overall size reduction, as well as an increase in strength. An increase in strength of the printhead substrate is also exhibited due to the curved end walls 144, 146 of the ink delivery slot 94, 96, 98 produced during the fabrication process as a result of the use of the rotary cutting saw 110. In addition, the rotary cutting saw 110 can be used to produce ink delivery slots 94, 96, 98 of greater lengths while maintaining manufacturing efficiencies. Specifically, the rotary cutting saw 110 can be used to form an ink delivery slot 94, 96, 98 having a length greater than 5000 $\mu$m. Moreover, the printhead die 40 incorporating the substrate 68 of the present invention provides the above features throughout the useful life of the printhead cartridge 16 to which the printhead die 40 is mounted so as to preclude premature replacement of the printhead cartridge 16 and the associated cost. Lastly, the printhead die 40 of the present invention is relatively easy and inexpensive to manufacture, and is relatively simple to incorporate into printhead cartridges 16 used in thermal inkjet printing systems 10.

Although the present invention has been described with reference to preferred embodiments, those skilled in the art will recognize that changes may be made in form and detail without departing from the spirit and scope of the invention.

What is claimed is:

1. A printhead comprising:

a substrate extending between a first substrate surface and a generally opposing second substrate surface:

a plurality of firing chambers positioned over the first surface; and, at least one fluid channel that delivers fluid to the plurality of firing chambers, the at least one fluid channel extending between the first surface and the second surface and is defined by first and second substantially parallel side walls that are generally orthogonal to the first surface and first and second non-parallel end walls that are not orthogonal to the first surface.

2. The printhead of claim 1 wherein each of the first and second end walls is non-linear.

3. The printhead of claim 1 wherein each of the first and second end walls is curved.

4. The printhead of claim 3 wherein the first end wall is defined by a first arc having a first radius of curvature having a first focus, and wherein the second end wall is defined by a second arc having a second radius of curvature having a second focus and wherein the first focus and the second focus do not lie in a space defined between the first surface and the second surface.

5. The printhead of claim 4 wherein the first radius of curvature is substantially equal to the second radius of curvature.

6. The printhead of claim 3 wherein when viewed alone a cross-section taken parallel to the first sidewall and orthogonal to the first surface, the first and second endwalls define a portion of a shape which is convex toward the first surface.

7. The printhead of claim 1 wherein the at least one fluid channel has a width dimension defined as the distance between the first and second side walls, and wherein the width dimension is at least 15 $\mu$m and less than 300 $\mu$m.

8. The printhead of claim 7 wherein the width dimension of the at least one fluid channel is 200 $\mu$m.

9. The printhead of claim 1 wherein the at least one fluid channel has a length dimension defined as the distance between the first and second end walls, and wherein the length dimension is at least 5000 $\mu$m.

10. The printhead of claim 9 wherein the length dimension of the at least one fluid channel is at least 8000 $\mu$m.

11. The printhead of claim 10 wherein the length dimension of the at least one fluid channel is 8750 $\mu$m.

12. The printhead of claim 1 wherein the at least one fluid channel has a width dimension defined as the distance between the first and second side walls and a length dimension defined as the distance between the first and second end walls, and wherein the width dimension is at least 15 $\mu$m and less than 300 $\mu$m, and the length dimension is at least 5000 $\mu$m.

13. The printhead of claim 12 wherein the width dimension is 200 $\mu$m and the length dimension is 8750 $\mu$m.

14. The printhead of claim 1 wherein the at least one fluid channel is a plurality of fluid channels.

15. A printhead cartridge comprising:

a cartridge body; and a printhead die mounted to the cartridge body, the printhead die having a first major surface and an opposite second major surface, the printhead die including:

a plurality of firing chambers; and, at least one fluid channel for delivering fluid to the plurality of firing chambers, wherein the at least one fluid channel is defined by first and second side walls that are substantially perpendicular to the first major surface, and first and second end walls that are not perpendicular to the first major surface.

16. The printhead cartridge of claim 15 wherein each of the first and second end walls intersect at a point which does not lie in a space defined between a first plane containing the first major surface and a second plane containing the second major surface.

17. The printhead cartridge of claim 16 wherein the first end wall is defined by a first arc having a first radius of curvature, wherein the second end wall is defined by a second arc having a second radius of curvature, and wherein the first radius of curvature is substantially equal to the second radius of curvature.

18. The printhead cartridge of claim 15 wherein the at least one fluid channel has a width dimension defined as the distance between the first and second side walls and a length dimension defined as the distance between the first and second end walls, and wherein the width dimension is at least 15 $\mu$m and less than 300 $\mu$m, and the length dimension is at least 5000 $\mu$m.

19. The printhead cartridge of claim 18 wherein the width dimension is 200 $\mu$m and the length dimension is 8750 $\mu$m.

20. The printhead cartridge of claim 15 wherein the at least one fluid channel is a plurality of parallel fluid channels.

21. The printhead cartridge of claim 15 wherein each of the first and second end walls is curved and is concave toward the first major surface.

22. A semiconductor substrate having microelectronics integrated thereon comprising:

at least one fluid feed channel formed in a substrate between a first substrate surface and a generally opposing second substrate surface;

a plurality of fluid ejecting elements positioned over the second substrate surface; and, the at least one fluid feed channel being configured to deliver fluid to the plurality of fluid ejecting elements, wherein the at least one fluid feed channel is defined at least in part by a first generally curved endwall that is concave toward the first surface and away from the second surface.

23. The semiconductor substrate of claim 22 further comprising a second generally curved endwall that is concave toward the first surface and away from the second surface.

24. The semiconductor substrate of claim 23, wherein the first end wall is defined by a first arc having a first radius of curvature, and wherein the second end wall is defined by a second arc having a second radius of curvature.

25. The semiconductor substrate of claim 24, wherein the first radius of curvature is substantially equal to the second radius of curvature.

26. The semiconductor substrate of claim 24, wherein the first radius of curvature has a first focus which does not lie between the first surface and the second surface and wherein the second radius of curvature has a second focus which does not lie between the first surface and the second surface.

27. The semiconductor substrate of claim 26, wherein the first focus and the second focus are positioned oppositely the second surface relative to the first surface.

28. A fluid ejecting device comprised at least in part by the semiconductor substrate of claim 22.

29. A printing device comprised at least in part by the semiconductor substrate of claim 22.

30. The printing device of claim 29, wherein the printing device comprises a printer.

31. The semiconductor substrate of claim 22, wherein the fluid comprises ink.

32. A printhead comprising:

a substrate having a depth; and at least one fluid channel disposed within the substrate and comprising a first dimension that is substantially defined by the depth, the at least one fluid channel being further defined by first and second linear and substantially parallel side walls and first and second non-parallel end walls.

* * * * *